US008983101B2

(12) United States Patent
Grinker et al.

(10) Patent No.: US 8,983,101 B2
(45) Date of Patent: Mar. 17, 2015

(54) EARPHONE ASSEMBLY

(75) Inventors: Scott Charles Grinker, Vernon Hills, IL (US); Paris Nicholas Tsangaris, Des Plaines, IL (US); Steven R. Grosz, Kenosha, WI (US); Kyle Patrick Glavan, Evanston, IL (US); Lajos Frohlich, Forest Park, IL (US); Gabor Zanoni, Cambridge, MA (US); Mark Bui Breneman, Brooklyn, NY (US)

(73) Assignee: Shure Acquisition Holdings, Inc., Niles, IL (US)

( * ) Notice: Subject to any disclaimer, the term of this patent is extended or adjusted under 35 U.S.C. 154(b) by 353 days.

(21) Appl. No.: 13/477,874

(22) Filed: May 22, 2012

(65) Prior Publication Data

US 2013/0315431 A1 Nov. 28, 2013

(51) Int. Cl.
*H04R 25/00* (2006.01)

(52) U.S. Cl.
USPC ..... 381/322; 381/328

(58) Field of Classification Search
CPC ..... H04R 2225/021; H04R 2225/025; H04R 2225/41; H04R 2225/63; H04R 25/60; H04R 24/65; H04R 25/70; H04R 25/356; H04R 25/456; H04R 25/505; H04R 25/554; H04R 25/652
USPC ..... 381/312, 328, 330, 322
See application file for complete search history.

(56) References Cited

U.S. PATENT DOCUMENTS

| | | | |
|---|---|---|---|
| 5,692,059 | A | 11/1997 | Kruger |
| 5,694,475 | A | 12/1997 | Boyden |
| 5,749,912 | A | 5/1998 | Zhang |
| 6,129,174 | A | 10/2000 | Brown |
| 6,205,227 | B1 | 3/2001 | Mahoney |
| 6,567,526 | B1 | 5/2003 | Killion |
| RE38,351 | E | 12/2003 | Iseberg |
| D488,460 | S | 4/2004 | Alwicker |
| 6,724,902 | B1 | 4/2004 | Shennib |
| D494,956 | S | 8/2004 | Sabick |
| 6,996,243 | B2 | 2/2006 | Welker |
| D519,103 | S | 4/2006 | Sabick |

(Continued)

FOREIGN PATENT DOCUMENTS

| | | |
|---|---|---|
| BE | 797139 | 7/1973 |
| WO | 2011033136 | 3/2011 |

(Continued)

OTHER PUBLICATIONS

International Search Report and Written Opinion for PCT/US2013/038603, dated Jul. 8, 2013, 12 pages.

*Primary Examiner* — Brian Ensey
(74) *Attorney, Agent, or Firm* — Banner & Witcoff, Ltd.

(57) ABSTRACT

An earphone assembly for an in-ear listening device and method for filtering a portion of an audible sound output are disclosed. An earphone comprises a housing configured to receive a nozzle, a plurality of drivers each having an acoustical output disposed within the housing, and an elongated passageway disposed within the housing configured to filter at least an audible portion of a sound wave output from at least one of the plurality of drivers. The method comprises providing an elongated passageway to provide an increased path length and connecting an output of the at least one driver to the elongated passageway to configure the sound output to be received within the elongated passageway to acoustically filter a portion of the sound output from the at least one driver.

31 Claims, 9 Drawing Sheets

(56) References Cited

U.S. PATENT DOCUMENTS

| | | | | |
|---|---|---|---|---|
| 7,068,803 | B2 | 6/2006 | Kuhlmann | |
| 7,103,196 | B2 | 9/2006 | Warren | |
| 7,110,563 | B2 | 9/2006 | Bergere | |
| D542,773 | S | 5/2007 | Drambarean | |
| 7,240,765 | B2 | 7/2007 | Berg | |
| 7,263,195 | B2 | 8/2007 | Harvey | |
| D550,200 | S | 9/2007 | Drambarean | |
| D550,201 | S | 9/2007 | Drambarean | |
| 7,317,806 | B2 * | 1/2008 | Harvey et al. | 381/328 |
| 7,369,670 | B2 | 5/2008 | Haussmann | |
| 7,394,909 | B1 | 7/2008 | Widmen | |
| 7,508,953 | B2 | 3/2009 | Hilbowicki | |
| 7,512,243 | B2 | 3/2009 | Haussmann | |
| D603,844 | S | 11/2009 | Blanchard | |
| 7,616,772 | B2 | 11/2009 | Sabick | |
| 7,627,131 | B2 | 12/2009 | Nielsen | |
| 7,634,099 | B2 | 12/2009 | Harvey | |
| 7,657,048 | B2 | 2/2010 | van Halteren | |
| 7,680,292 | B2 | 3/2010 | Warren | |
| D613,726 | S | 4/2010 | Blanchard | |
| 7,831,057 | B2 | 11/2010 | Jenkins | |
| D636,492 | S | 4/2011 | Aquilina | |
| 7,925,038 | B2 | 4/2011 | Taenzer | |
| 7,983,433 | B2 | 7/2011 | Nemirouski | |
| RE42,602 | E | 8/2011 | Krywko | |
| 7,991,179 | B2 | 8/2011 | Drambarean | |
| 8,005,240 | B2 | 8/2011 | Linse | |
| 8,031,900 | B2 | 10/2011 | Dyer | |
| 8,055,007 | B2 | 11/2011 | Kim | |
| 8,135,163 | B2 | 3/2012 | Blanchard | |
| 8,180,094 | B2 | 5/2012 | Harvey | |
| 8,194,911 | B2 | 6/2012 | Dyer | |
| 2005/0018838 | A1 | 1/2005 | Meunier | |
| 2005/0147267 | A1 | 7/2005 | Gudmunsen | |
| 2005/0249369 | A1 | 11/2005 | Angst | |
| 2006/0042867 | A1 | 3/2006 | Haussmann | |
| 2006/0109999 | A1 | 5/2006 | van Halteren | |
| 2007/0189569 | A1 | 8/2007 | Haapapuro | |
| 2008/0063223 | A1 | 3/2008 | van Halteren | |
| 2008/0124981 | A1 | 5/2008 | Jorgensen | |
| 2008/0240485 | A1 | 10/2008 | Dyer | |
| 2009/0041262 | A1 | 2/2009 | Harvey | |
| 2009/0060245 | A1 | 3/2009 | Blanchard | |
| 2009/0147981 | A1 | 6/2009 | Blanchard | |
| 2009/0154747 | A1 | 6/2009 | Vestergaard | |
| 2010/0111341 | A1 | 5/2010 | Ditti | |
| 2010/0202643 | A1 | 8/2010 | Nielsen | |
| 2010/0254556 | A1 | 10/2010 | Warren | |
| 2010/0307859 | A1 | 12/2010 | Lopez | |
| 2010/0310106 | A1 | 12/2010 | Blanchard | |
| 2010/0322453 | A1 | 12/2010 | Matsuyama | |
| 2010/0322454 | A1 | 12/2010 | Ambrose | |
| 2011/0051980 | A1 | 3/2011 | Kuhr | |
| 2011/0051981 | A1 | 3/2011 | Lehdorfer | |
| 2011/0058702 | A1 | 3/2011 | Saggio | |
| 2011/0064238 | A1 | 3/2011 | Haas | |
| 2011/0103605 | A1 | 5/2011 | Killion | |
| 2011/0103610 | A1 | 5/2011 | Harsch | |
| 2011/0103636 | A1 | 5/2011 | Pelland | |
| 2011/0158440 | A1 | 6/2011 | Mei | |
| 2011/0255723 | A1 | 10/2011 | Obradovic | |
| 2011/0261985 | A1 * | 10/2011 | Rung et al. | 381/328 |

FOREIGN PATENT DOCUMENTS

| | | |
|---|---|---|
| WO | 2011131453 | 5/2011 |
| WO | 2011050862 | 10/2011 |

* cited by examiner

EARPHONE ASSEMBLY

TECHNICAL FIELD

The disclosure herein relates to the field of sound reproduction, and more specifically to the field of sound reproduction using an earphone. Aspects of the disclosure relate to earphones for in-ear listening devices ranging from hearing aids to high quality audio listening devices to consumer listening devices.

BACKGROUND

Personal "in-ear" monitoring systems are utilized by musicians, recording studio engineers, and live sound engineers to monitor performances on stage and in the recording studio. In-ear systems deliver a music mix directly to the musician's or engineer's ears without competing with other stage or studio sounds. These systems provide the musician or engineer with increased control over the balance and volume of instruments and tracks, and serve to protect the musician's or engineer's hearing through better sound quality at a lower volume setting. In-ear monitoring systems offer an improved alternative to conventional floor wedges or speakers, and in turn, have significantly changed the way musicians and sound engineers work on stage and in the studio.

Moreover, many consumers desire high quality audio sound, whether they are listening to music, DVD soundtracks, podcasts, or mobile telephone conversations. Users may desire small earphones that effectively block background ambient sounds from the user's outside environment.

Hearing aids, in-ear systems, and consumer listening devices typically utilize earphones that are engaged at least partially inside of the ear of the listener. Typical earphones have one or more drivers of either dynamic moving-coil or balanced armature design that are mounted within a housing. Typically, sound is conveyed from the output port of the driver(s) into the user's ear canal through a cylindrical sound port or a nozzle.

Multiple driver earphones can produce a more accurate frequency response especially in the lower frequency range typical of a bass guitar or bass drum. A better quality sound output is realized by optimizing the particular driver for a specific sound region because the particular driver can be designed specifically for a particular frequency range. Additionally multi-driver earphones are able to provide greater volume sound without as much distortion, thereby yielding a cleaner sound in higher decibel settings. However, it is also desired to filter the higher frequencies produced by the low frequency driver to optimize the performance or sound quality of the earphone, as discussed in more detail below.

In a related field, passive electrical methods acting as low pass filters are common in loudspeakers. Loudspeaker crossover designs often use a simple first order passive electrical network to create low and high pass filters, primarily to allow each speaker to work in its efficient range and to avoid damage to drivers not designed to reproduce particular frequencies. Properly designed crossovers also minimize destructive phase interactions between multiple acoustic sources that reproduce overlapping frequency regions. Appropriately paired low and high pass filters also prevent a parallel electrical network of drivers from presenting an excessively low load impedance to the source amplifier. Passive networks often use inductors to create low-pass filters electronically, with the performance of the inductor directly related to its number of coil turns.

However, in regard to multi-driver earphone design, the use of inductors for low pass filtering presents two significant hurdles in practical implementations. First, the requirement for a large number of turns results in a rather large package size. Second, the use of small gauge wire utilized to maximize the number of turns per unit of inductor volume results in significantly higher values of DC resistance. When placed in electrical series with the receiver, this DC resistance results in an undesirable decrease in receiver output sensitivity, which adversely affects the sound quality of the earphone. The embodiments disclosed herein are aimed at overcoming the practical implementations of the use of inductors in conjunction with low frequency drivers as discussed above; however, this does not preclude inductors being implemented in conjunction with any of the embodiments disclosed herein.

Undesired higher frequency sound output from a low frequency driver can be filtered by increasing the sound passage length from the driver output to the output of the earphone. Acoustic inertance, which is the impeding effect of inertia on the transmission of sound in a duct of small cross-sectional area or the mass loading of air on the transmission of sound in a duct, can be calculated by the following equation, where $\rho_0$ is the density of air and L is the length of the tube in meters, A is the cross-sectional area of the tube in meters-squared, and $\omega$ is the angular frequency of the sound wave in radians $$Z_A = \frac{\rho_0 L}{A} j\omega$$

(in units of $kg/m^4$).

As illustrated by the above equation, the acoustic impedance of the tube is directly proportional to both the length of the tube and the frequency of the excitation signal, and inversely proportional to the cross-sectional area of the tube. This acoustic mass element presents a reactive (i.e. energy absorbing) load to the acoustic pressure source, and as such, is analogous to an inductive element that presents a reactive load to a voltage source in the electrical domain. In the acoustic domain, this inertial load presents a linearly increasing impedance with frequency, thus serving as a first-order low-pass acoustic filter element. Therefore, an effective strategy to acoustically discriminate against higher frequency sound waves produced by the low frequency driver is to utilize a sufficiently large tube length in combination with a sufficiently small tube cross-sectional area. However, earphones worn in the ear canal are very small volumetrically, and for acoustic tubing commonly used in the art, it is very difficult to fit the required tube length within the earphone casing.

For example, short silicone tubes can be implemented to create a subtle low pass acoustic filter effect or tune a resonance peak to a target frequency, but a longer tube would need to be coiled or folded up in the small volume of an in-ear earphone, which may not be available to achieve the desirable performance. Although tubes may be used in conjunction with any of the embodiments disclosed herein, it proves difficult to use tubes to provide the appropriate length for the desired roll off of higher frequency sound waves with current earphone geometry, especially for multi-driver earphones.

BRIEF SUMMARY

The present disclosure contemplates earphone driver assemblies. The following presents a simplified summary of the disclosure in order to provide a basic understanding of some aspects. It is not intended to identify key or critical elements of the invention or to delineate the scope of the invention. The following summary merely presents some concepts of the disclosure in a simplified form as a prelude to the more detailed description provided below.

In an exemplary embodiment, an earphone assembly has a housing, a first driver configured to produce a first audio output, a second driver configured to produce a second audio output, and a nozzle coupled to the housing. An elongated passageway is connected to the first driver and is contained within the housing. The elongated passageway has a length and cross sectional area and comprises a tortuous path having multiple turns winding internally within the housing. The length and cross-sectional area of the elongated passageway is configured as an acoustic filter for filtering at least an audible portion of the sound from the audio output of the first driver.

In another exemplary embodiment, an earphone assembly comprises a housing configured to receive a nozzle for outputting sound and a plurality of drivers each having an output disposed within the housing. At least one of the drivers is connected to an elongated passage acoustically coupled to the nozzle. The elongated passageway is formed of a network of differently shaped passages disposed within the housing. The elongated passageway extends in each of the X, Y, and Z directions. The length and cross-sectional area of the elongated passageway are configured to filter at least an audible portion of a sound wave output from the at least one of the plurality of drivers.

In another exemplary embodiment, a method of filtering an acoustic output in an earphone is disclosed. The method comprises forming an elongated passageway from a plurality of stacked layers, housing the elongated passageway and at least one driver configured to provide an acoustic output within an earphone casing. The method further comprises connecting the output of the at least one driver to the elongated passageway, and configuring the acoustic output to be received within the elongated passageway to acoustically filter at least a portion of the acoustic output from the at least one driver.

BRIEF DESCRIPTION OF THE DRAWINGS

The present disclosure is illustrated by way of example and not limited in the accompanying figures.

DETAILED DESCRIPTION OF THE INVENTION

Figure 1:
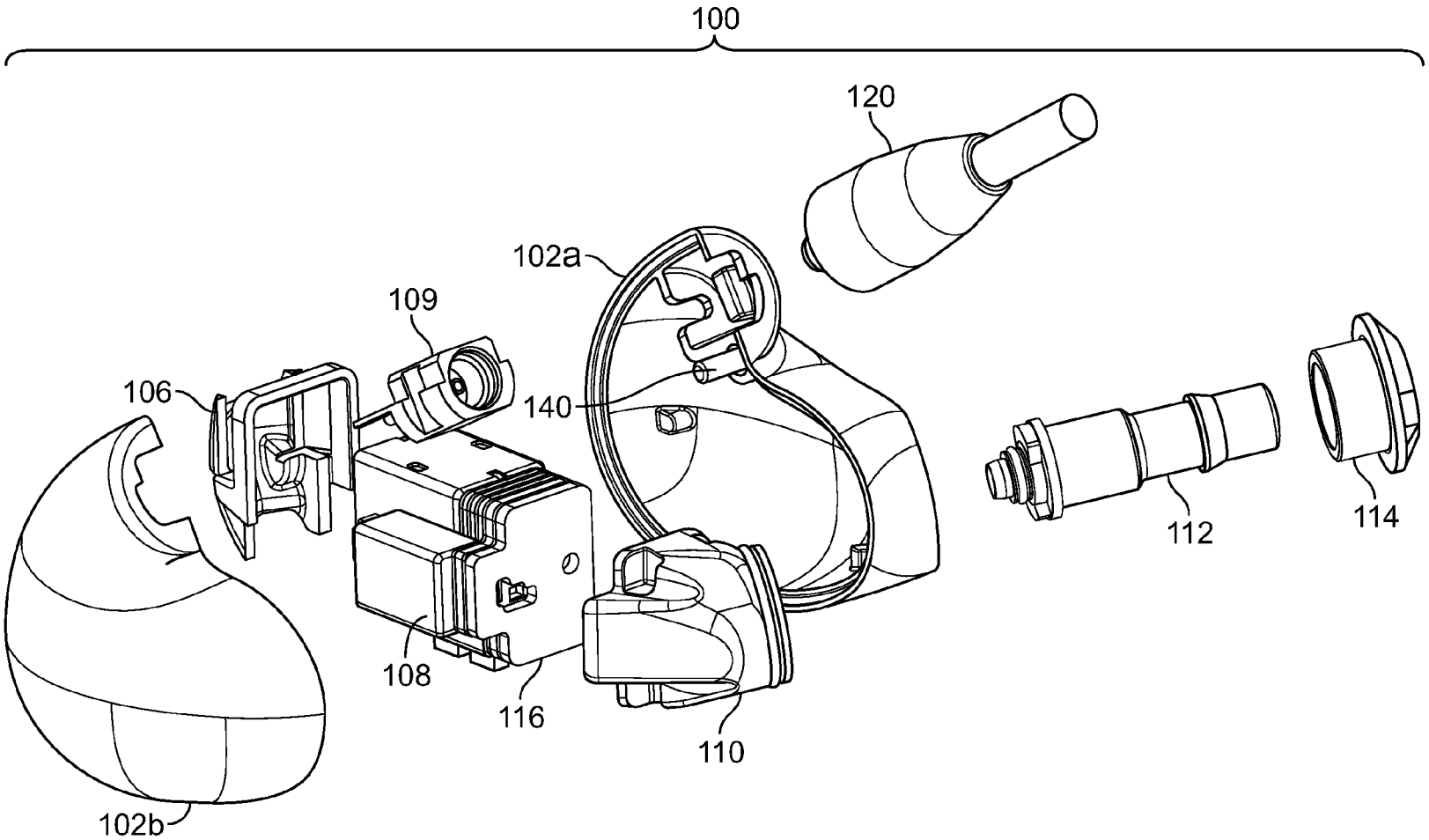
FIG. 1 shows an exploded view of an exemplary embodiment of an earphone.
Figure 2A:
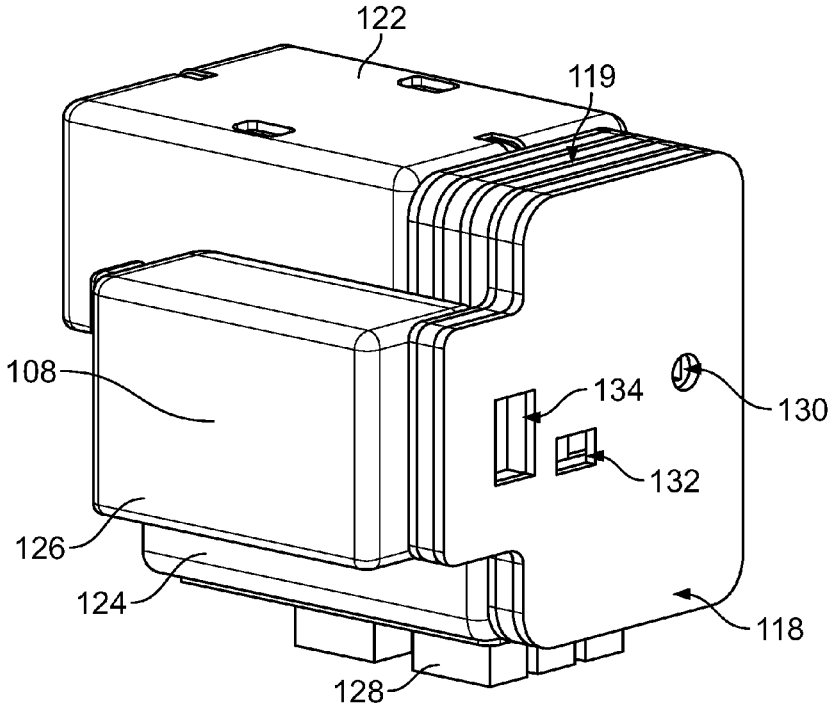
FIG. 2A shows a front left perspective view of a portion of the exemplary embodiment in FIG. 1.
Figure 2B:
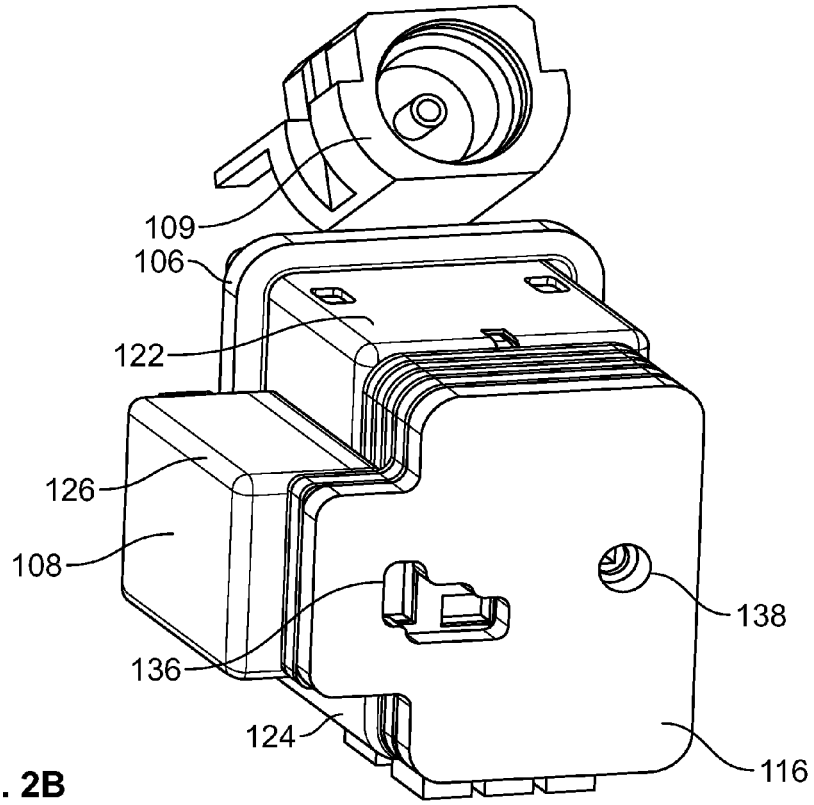
FIG. 2B shows another front left perspective view of another portion of the exemplary embodiment in FIG. 1.
Figure 2C:
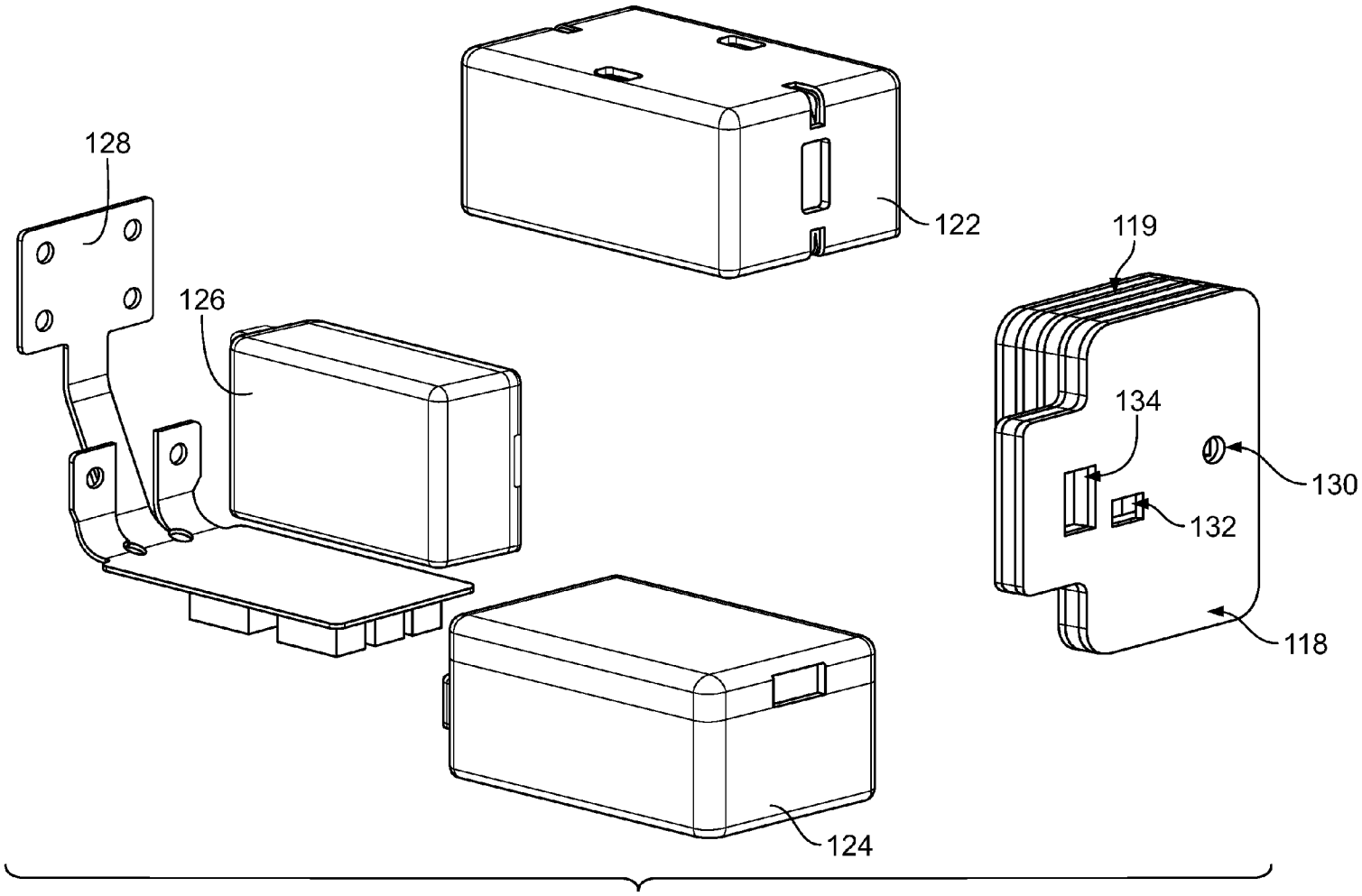
FIG. 2C shows a front left exploded view of the portion of the exemplary embodiment of FIG. 1 shown in FIG. 2A.

FIG. 1 depicts an exploded view of an earphone assembly. The earphone 100 comprises a case 102*a* and a cover 102*b*, which together form a housing or casing for the earphone. A cable 120 connects to the housing and provides an input signal to a connector 109, typically in the form of an audio signal desired to be played by the earphone 100. A driver assembly 108 can be placed within the housing on a carrier 106. The carrier 106 retains the driver assembly 108. The connector 109 is held in place within the housing by the case 102*a* and the cover 102*b*. A nozzle interface 110 is provided for acoustically connecting the driver assembly 108 to a nozzle 112, which can be configured to be replaceable by a user by way of a threaded collar 114. A guide pin 140 can be placed on one of the case 102*a* or the cover 102*b* to provide for additional sealing of the case 102*a* and the cover 102*b* and to aid in the manufacturing of the earphone 100.

As shown in FIGS. 1, 2A-2C, the driver assembly 108 comprises a dual low frequency driver 122, a mid-frequency driver 124, a high frequency driver 126, an acoustic seal 116, which can be formed of Poron®, a manifold 118, a labyrinth 119 and a crossover flex PCB 128. The drivers 122, 124, and 126 can be arranged adjacent to each other on the manifold 118 and labyrinth 119 within the housing for the earphone 100. The labyrinth 119 and the manifold 118 can each be formed as box-like or as a prism. The labyrinth 119 and the manifold 118 together can form an integral structure for mounting the drivers 122, 124, and 126. In particular the dual low frequency driver 122 is mounted on a face of the labyrinth 119, and the mid-frequency driver 124 and the high frequency driver 126 can be mounted on a common face of the manifold 118. In one exemplary embodiment, the drivers 122, 124, and 126 can be formed without spouts, which provides for a smaller and more compact structure within the earphone housing.

The labyrinth 119 and the manifold 118 together form an elongated passageway 130 for receiving the acoustic output from the dual low frequency driver 122 and together and separately act as an acoustic filtering structure. The manifold 118 is also provided with a mid-frequency port 132 for receiving the acoustic output from the mid-frequency driver 124, and a high frequency port 134 for receiving the acoustic output from the high frequency driver 126. Each of the elongated passageway 130, the mid-frequency port 132, and the high frequency port 134 can share the common integral structure formed by the labyrinth 119 and the manifold 118.

The acoustic seal 116 is provided with a first port 136 configured to receive the outputs from the manifold high frequency port 134 and the mid-frequency port 132. The acoustic seal 116 is also provided with a second port 138 configured to receive the output from the elongated passageway 130. The first port 136 of the acoustic seal 116 can act as a mixing area for the high frequency driver 126 and the mid-frequency driver 124. However, it is contemplated that the acoustic seal 116 can be arranged in any number of different ways to mix the various outputs of the drivers 122, 124, 126 and to optimize the sound quality of the earphone. For example, it is contemplated that the mid-frequency driver 124 sound output could be mixed with the sound output from the dual low-frequency driver 122 in the acoustic seal 116. This may depend on the particular design parameters for the earphone. It may be desirable to route the paths of the drivers to add acoustic resistance or dampers to specific pathways of the drivers. For example, high damping may be required on the low frequency driver path, and the mid-frequency driver and the low frequency driver can share similar damping.

Figures 3A, 3B:
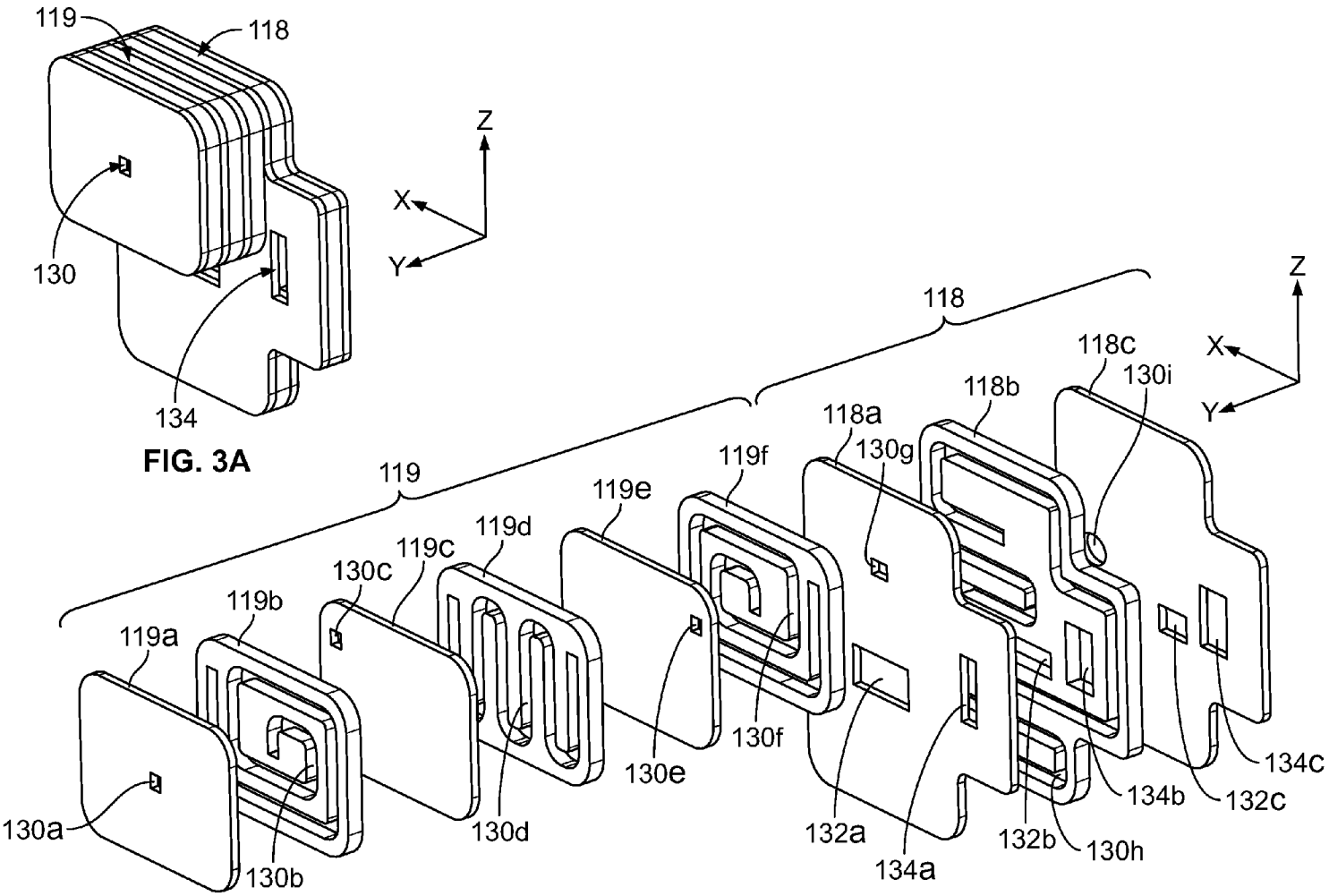
FIG. 3A shows a rear left view of an exemplary embodiment of another portion of the exemplary embodiment in FIG. 1.
FIG. 3B shows a rear left exploded view of FIG. 3A.

An exemplary embodiment of the labyrinth 119 and the manifold 118 is shown in FIGS. 3A and 3B. In this embodiment, as shown in an exploded view in FIG. 3B, the labyrinth 119 can be formed as a series of stacked layers or plates 119*a*-119*f*. Likewise, the manifold 118 can be formed as a series of stacked layers or plates 118*a*-118*c*. The stacked layers may be made of metal or other appropriate material.

The elongated passageway 130 forms the labyrinth 119, and travels through the manifold 118. The elongated passageway 130 is a long maze-like channel that has multiple turns winding and twisting through the labyrinth 119 and the manifold 118 contained within the housing 102*a*, 102*b*. The elongated passageway 130 essentially acts as a long tube folded up into the constrained volume of the earphone 100. The elongated passageway 130 or long path acts as an acoustic transmission line, and in simple terms acts as a low pass filter in the low frequency range. In other words, the elongated passage 130 in the manifold 118 attenuates high frequency energy output from the dual low frequency driver 122.

The low frequency channel 130 is formed by providing alternating layers 119*a*, 119*c*, 119*e*, 118*a*, and 118*c* with ports 130*a*, 130*c*, 130*e*, 130*g*, and 130*i* and layers 119*b*, 119*d*, 119*f*, and 118*b* with a network of elongated passageways 130*b*, 130*d*, 130*f*, and 130*h* formed in the labyrinth 119 and in the manifold 118. Each of the ports 130*a*, 130*c*, 130*e*, 130*g*, and 130*i* and elongated passageways 130*b*, 130*d*, 130*f*, and 130*h* act as both an input and output for sound to travel through the labyrinth 119 and manifold 118.

The elongated passageways 130*b*, 130*d*, 130*f*, and 130*h* comprise elongated channels cut or formed into the layers 119*b*, 119*d*, 119*f*, and 118*b* that extend lengthwise and widthwise on the largest surface area of the particular layer. The layers 119*b*, 119*d*, 119*f*, and 118*b* can be considered a first subset of the stacked layers and are formed with differently shaped elongated passageways 130*b*, 130*d*, 130*f*, and 130*h*. The layers 119*a*, 119*c*, 119*e*, 118*a*, and 118*c* can be considered a second subset of stacked layers and the ports 130*a*, 130*c*, 130*e*, 130*g*, and 130*i* permit sound to pass through each of the second subset of stacked layers into an adjoining one of the first subset of the stacked layers. As shown in FIG. 3B, the first subset and the second subset can be configured to alternate between each other.

The elongated passageways 130*b*, 130*d*, 130*f*, and 130*h* can be formed of differing lengths depending on the amount of surface area available on a particular layer. For example, layer 118*b* on the manifold 118 has a larger surface area than the layers 119*b*, 119*d*, 119*f* on the labyrinth 119 and, thus, can provide a longer elongated channel 130*h*. The elongated passages 130*b*, 130*d*, 130*f*, and 130*h* form an intricate combination of paths or passages for the sound from the dual low frequency driver 122 to travel. This network of elongated passageways 130*b*, 130*d*, 130*f*, and 130*h* can be formed in many different configurations to provide effective length for the sound to travel. The elongated passage 130 can be formed as an irregular tortuous path and in different shapes and arrangements as depicted in FIG. 3B, for example, spiral, wave, etc. Other shapes and configurations that achieve an elongated passageway are also contemplated.

Moreover, as shown in FIG. 3B the elongated passageway 130 provides a pathway for sound in all three dimensions X, Y, and Z throughout the labyrinth 119 and the manifold 118. Additionally, the elongated passageway 130 can be formed with a constant diameter or the same diameter throughout the labyrinth 119 and the manifold 118 to provide the requisite amount of acoustic inertance in the passageway 130. The sound will move within the elongated passageway 130 in each of the X, Y, and Z directions such that a substantial amount of the volume taken up by the labyrinth 119 and the manifold 118 provides pathway for the sound to travel from the dual low frequency driver 122, thereby filtering the acoustical output from the low frequency driver 122.

The high frequency port 134 and the mid-frequency port 132 can be formed using a similar method as the low frequency channel 130. The mid-frequency port 132 can be formed in the successive layers 118*a*-118*c* of the manifold 118 by forming individual slots or openings 132*a*, 132*b*, 132*c* in the layers 118*a*-118*c*. Likewise, the high frequency port 134 can be formed in the successive layers 118*a*-118*c* of the manifold 118 by forming individual slots or openings 134*a*, 134*b*, and 134*c* in the layers 118*a*-118*c*.

The layers 119*a*-119*f* and 118*a*-118*c* can be formed by new laser cutting methods, which allow for the tight control and precision that is needed to form an accurate cross section in the labyrinth 119 and the manifold 118. The layers 119*a*-119*f* and 118*a*-118*c* may be formed of metal, plastic, or any other appropriate materials formed into the geometric configurations described herein. The individual layers 119*a*-119*f* and 118*a*-118*c* of the labyrinth 119 and the manifold 118 can be glued or welded together. In one exemplary embodiment, each layer of the labyrinth 119 and the manifold 118 can be laser welded along its outside edge along the perimeter and then the layers 119*a*-119*f* and 118*a*-118*c* of the labyrinth 119 and manifold 118 can be laser welded on the edge surfaces in a direction perpendicular to the largest surface areas of the layers. Other techniques known in the art are also contemplated for securing the individual layers 119*a*-119*f* and 118*a*-118*c* of the labyrinth 119 and the manifold 118. The layers 119*a*-119*f* of the labyrinth and the layers 118*a*-118*c* of the manifold can be laser cut and laser welded or glued together. However, it is also contemplated that other methods of forming the labyrinth 119 and the manifold 118 known in the art can be used, such as micro lithography, stereo lithography, or 3D printing.

As shown in FIG. 3B the elongated passageway 130 as formed in the layers 119*a*-119*f* and 118*a*-118*c* provides a much greater path length than the width or length of the labyrinth 119 or the individual widths and lengths of the individual layers 119*a*-119*f* and 118*a*-118*c* that form the labyrinth 119 and the manifold 118. As a result, the elongated passageways or channels 130*b*, 130*d*, 130*f*, and 130*h* provide a much increased length of the elongated passageway 130 per unit volume of the labyrinth 119.

The design of the manifold 118 takes up very little space (volumetrically) and uses only an acoustical technique to filter out higher frequency sounds. The elongated passageway 130, which forms a maze-like passage in the labyrinth 119 and the manifold 118, which again essentially acts as a long tube which can be folded up and fit in the space-constrained volume of an in-ear earphone. The volume of an earphone is space constrained. In particular, many components must fit within the earphone casing, as discussed above, for example, the driver assembly 108, the acoustic seal 116, the nozzle interface 110, etc. all must be fit within the earphone casing.

In one exemplary embodiment, the ratio of length to volume of the elongated passage 130 within the labyrinth is over 1.5 $m^{-2}$. For silicone tubing typically used in the art, the length to volume ratio is approximately 0.27 $m^{-2}$, which means that in one exemplary embodiment the labyrinth provides almost six times as much sound passage length per volume than a typical silicone tube. This advantageously provides the desired amount of filtering of high frequency sound within the earphone.

Another measure of the efficiency of the elongated passageway in the labyrinth as a low pass filter is the acoustic mass to volume ratio. Acoustic mass can also be referred to as the inertance, which for tubes can be calculated by the equation listed above. As discussed herein, it is difficult to provide the requisite amount of inertance within the small amount of space in an earphone. However, the labyrinth helps to overcome this difficulty in providing an acoustic mass to volume ratio of approximately $1.3\times10^{13}$ kg/m$^7$. A typical silicone tube provides an acoustic mass to volume ratio of a $4.2\times10^{11}$ kg/m$^7$, meaning that the labyrinth design can provide approximately 31 times more acoustic mass in a given volume than can a typical silicone tube.

Figure 7:
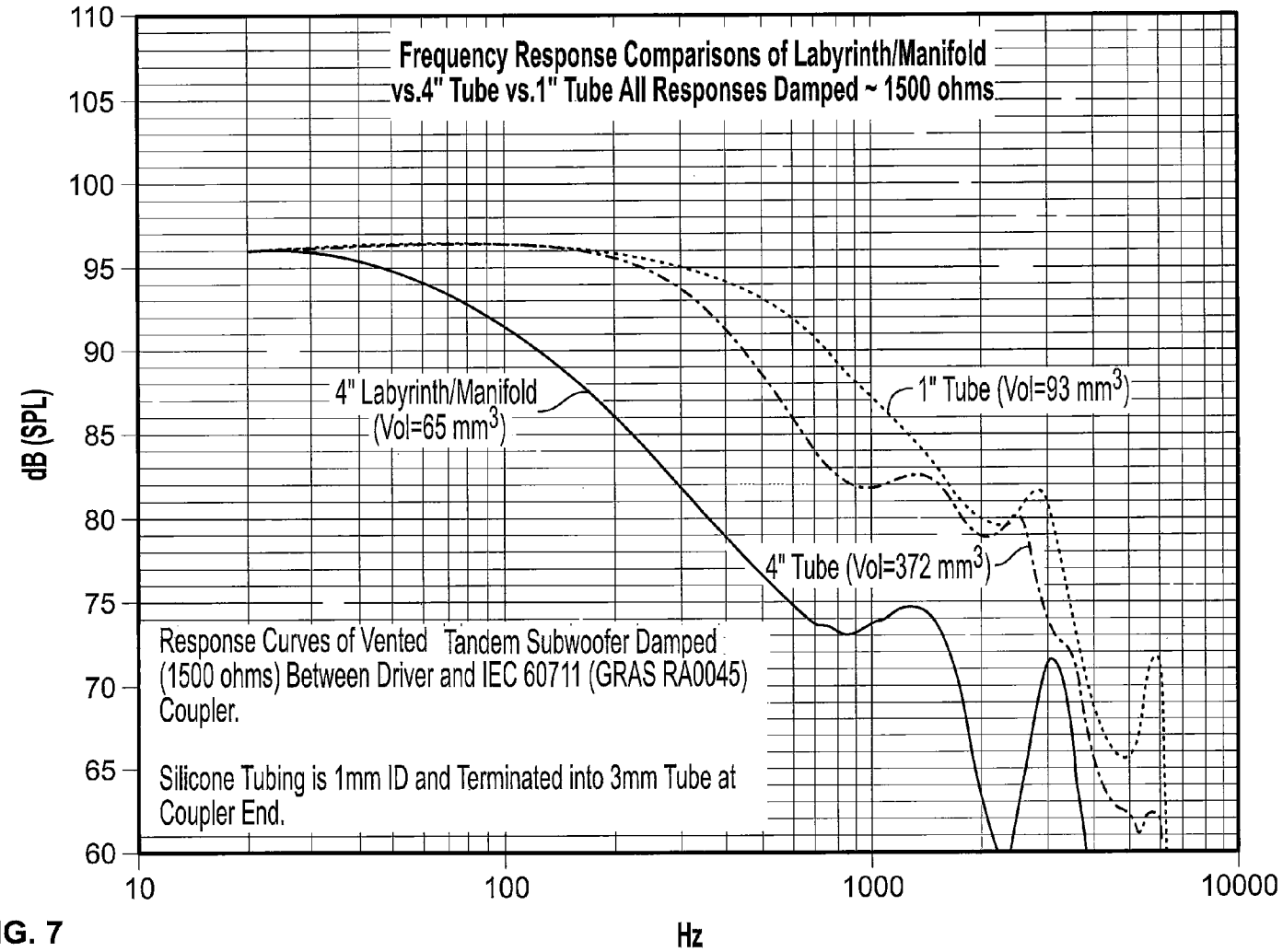
FIG. 7 shows a graphical comparison of frequency responses of an exemplary labyrinth/manifold assembly, a 4 in. tube, and a 1 in. tube.

FIG. 7 shows a comparison between a 1 in. length tube, which has a volume of 93 mm$^3$, a 4 in. tube having a volume of 372 mm$^3$, and the labyrinth 119/manifold 118 design described herein, which has a volume of 65 mm$^3$ and an effective length of 4 in. The graph shows that the labyrinth 119/manifold 118 design is able to provide a much improved cut-off frequency and low pass filter response, and more significantly, is capable of delivering this performance improvement while requiring far less volume than that required by a typical tube used in the art. The labyrinth 119 together with the manifold 118 provide over five times more acoustic mass at a sixth of the volume of an equivalent length tube typically used in the art. This results in cut-off frequency shifting downward from 330 Hz to 75 Hz, and a better performing low pass filter response. Additionally, the labyrinth 119 and manifold 118 design are also smaller volumetrically than a 1 in. tube that is typically used in the art and provides a better performing low pass filter response.

The viscous losses associated with the flow of acoustic volume velocity through the small cross-sectional area of the labyrinth effectively function to dampen the transmission-line half-wavelength resonance that would be present at roughly 1600 Hz. This resonance frequency coincides with an impedance minimum in the transmission line response function. In the absence of damping, this impedance null would permit the passage of undesirable high frequency sound waves. With the sufficient viscous damping provided by the small cross-section of the labyrinth 119 and the manifold 118, however, these high frequency sound waves are prevented from being transmitted through the labyrinth 119 and the manifold 118.

The elongated passageway 130 allows the acoustic output signals of the dual low frequency driver 122, which is focused on reproducing only low frequencies (in a multi-driver earphone) to dedicate itself only to the low-frequency content in an audio signal. This provides a few advantages: (1) the output level of low frequency content can be adjusted independent of mid and low frequency octave bands, which is often difficult to narrowly adjust in one or two driver systems (2) the cutoff frequency (knee) of the low pass filter can be set and controlled by the geometry (cross-sectional area and length) of the internal acoustic path of the elongated passageway 130 and (3) the driver(s) producing mid to high frequency energy no longer have to reproduce low frequency components of the source material, which reduces the potential for inter-modulation type distortions where the higher frequency component is modulating on top of the larger low frequency excursions and not faithfully reproducing the original source material as intended.

In one exemplary embodiment, the cross sectional area of the labyrinth 119 can be square like at 0.0155"×0.0160" (0.0002325 in$^2$). In one embodiment, the path length of the elongated passageway 130 of the device built can be 4.23" (107 mm) long and the path width or diameter can be 0.015 in., which results in a desirable cut-off frequency (−3 dB location at 20 Hz) of 63 Hz for the first-order filter (−6 dB per octave slope), in the frequency range up to 800 Hz in which the labyrinth functions as a lumped acoustic mass element.

In alternative embodiments, multiple elongated passageways can be created in the labyrinth 119 and the manifold 118 so that sound from the various drivers can be filtered. In one example, both the dual low frequency driver 122 and the mid-frequency driver 124 can be provided with an extended length passage in either the labyrinth 119 or the manifold 118 such that higher frequency sound can be filtered from each of the drivers to provide the desired sound output characteristics from the earphone. Similar to the low frequency driver 122, it may be beneficial to roll off higher frequencies from the mid frequency driver. To accomplish this, the passageways in the labyrinth 119 and the manifold 118 can be configured to provide a low pass filter at a higher knee or focused on rolling off higher frequencies output from the mid-frequency driver 124. Providing an acoustic filter for the mid-frequency driver (1) may reduce the frequency overlap with the high-frequency driver 126 to provide an improved frequency response, (2) may eliminate the need to use electrical filtering on the high-frequency driver 126, and (3) may introduce additional inertance in the signal path of the mid-frequency driver 124 to shift peak frequencies lower for a desired frequency response shape.

In another alternative embodiment, the labyrinth 119 and the manifold 118 together can act as a mounting location for attaching a shock absorbing mount or to assist with holding the case parts or housing parts together. For example, integrating extending features in the layers 119*a-f* of the labyrinth 119 and the layers 118*a-c* of the manifold 118 for mechanical purposes could reduce part complexity and costs. Any or all of the layers 119*a-f*, 118*a-c* of the labyrinth 119 or the manifold 118 could be utilized for this purpose to build up extending legs or connecting points for purposes such as but not limited to: a) creating indexing or keying features to assist with the assembly of the part(s), b) features to integrate with shock mounting materials, c) geometric (3D) features that assist with locating the driver sub-assembly within the housing, or d) cosmetic or industrial design elements for ornamental purposes.

In another alternative embodiment, resistance damping can be added into the elongated passage 130, the mid-frequency port 132, the high frequency port 134, and/or the layers 119*a*-119*f* of the labyrinth 119 or the layers 118*a*-118*c* of the manifold 118 to increase resistance and customize individual driver responses depending on the desired sound output for the earphone.

Figure 4:
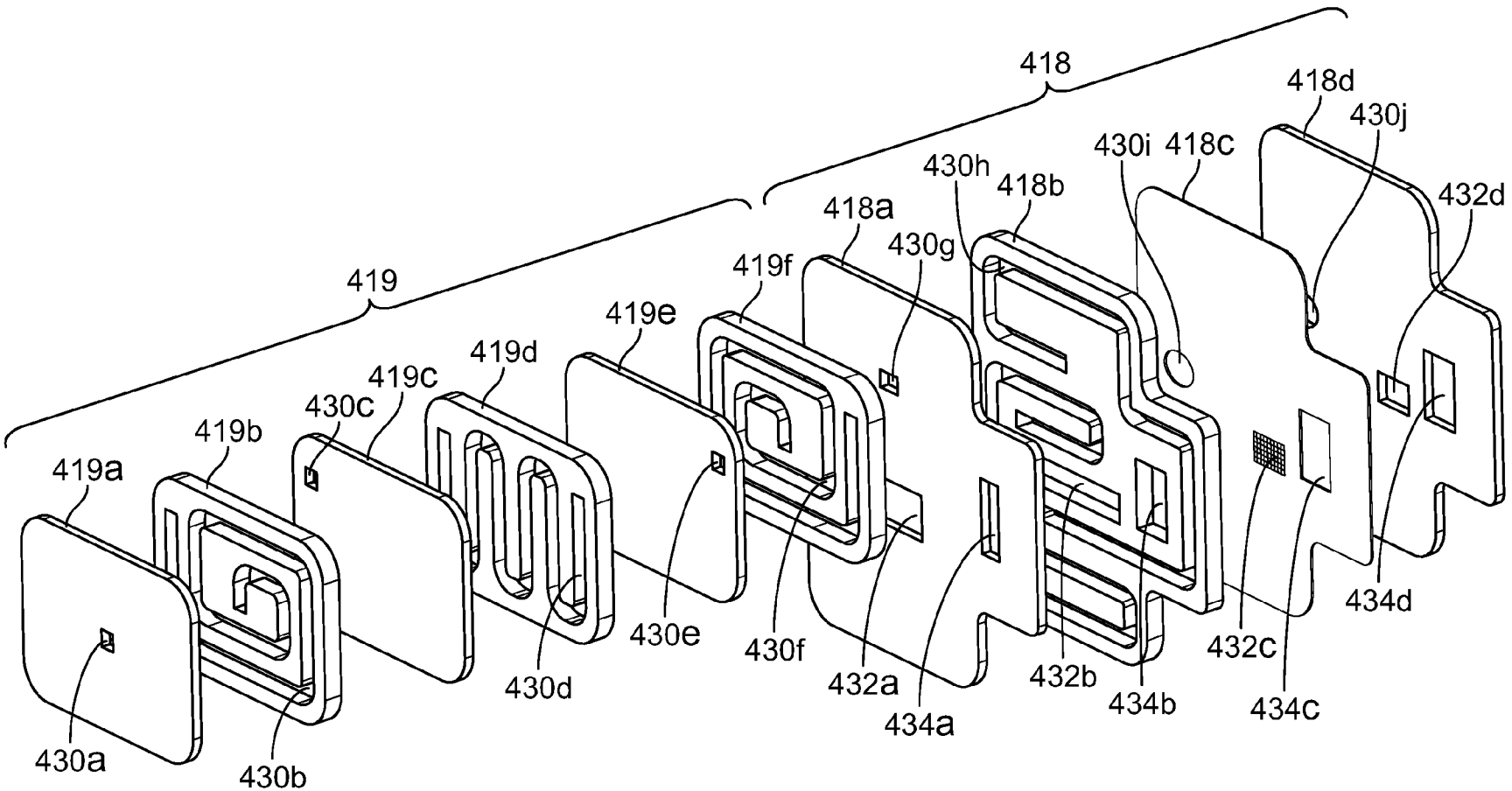
FIG. 4 depicts an exploded view of another exemplary embodiment.

An example of resistance damping integrated into structure of the manifold is shown in FIG. 4, where like reference numerals represent like components as the embodiment depicted in FIGS. 3A and 3B. The exemplary embodiment shown in FIG. 4 is similar to the embodiment shown in FIGS. 3A and 3B, except that the manifold 418 is formed with an additional layer 418*c* having a built-in matrix 432*c* that acts as a damping mechanism. As shown in FIG. 4, an [n×m] matrix 432*c* of tiny holes (40 to 80 micron diameter) are formed into the layer 418*c* of the manifold 418. The matrix 432*c* of tiny holes is designed to meet a target acoustical resistance value for viscous damping purposes, which is a different mechanism than the inertance method used in the labyrinth 419 discussed herein. In this particular embodiment, 9 columns×6 rows (54 holes) of 80 micron diameter holes evenly distributed over the mid-frequency path are used to form the matrix 432*c*. This provides a flexible method to damp the mid-frequency port or path 432*a*-432*d* with different resistance values. Additionally, any of the paths 430, 432, or 434 formed in the labyrinth 419 and the manifold 418 could be independently damped using this method.

In one exemplary embodiment, the layer 418*c* can be an electroformed layer of Nickel and can be formed very thin (roughly 0.001" thick). Additionally, the layers 418*b* and 418*d* can be formed of stainless steel. A seam weld can be formed around the full perimeter that is wide enough (approximately 0.005") to bridge the stainless steel layers 418*b* and 418*d* to sandwich the thinner electroformed layer 418*c*. This locks the dissimilar metal layer 418*c* into the assembly and provides a robust integral structure for forming the manifold 418.

Figure 5B:
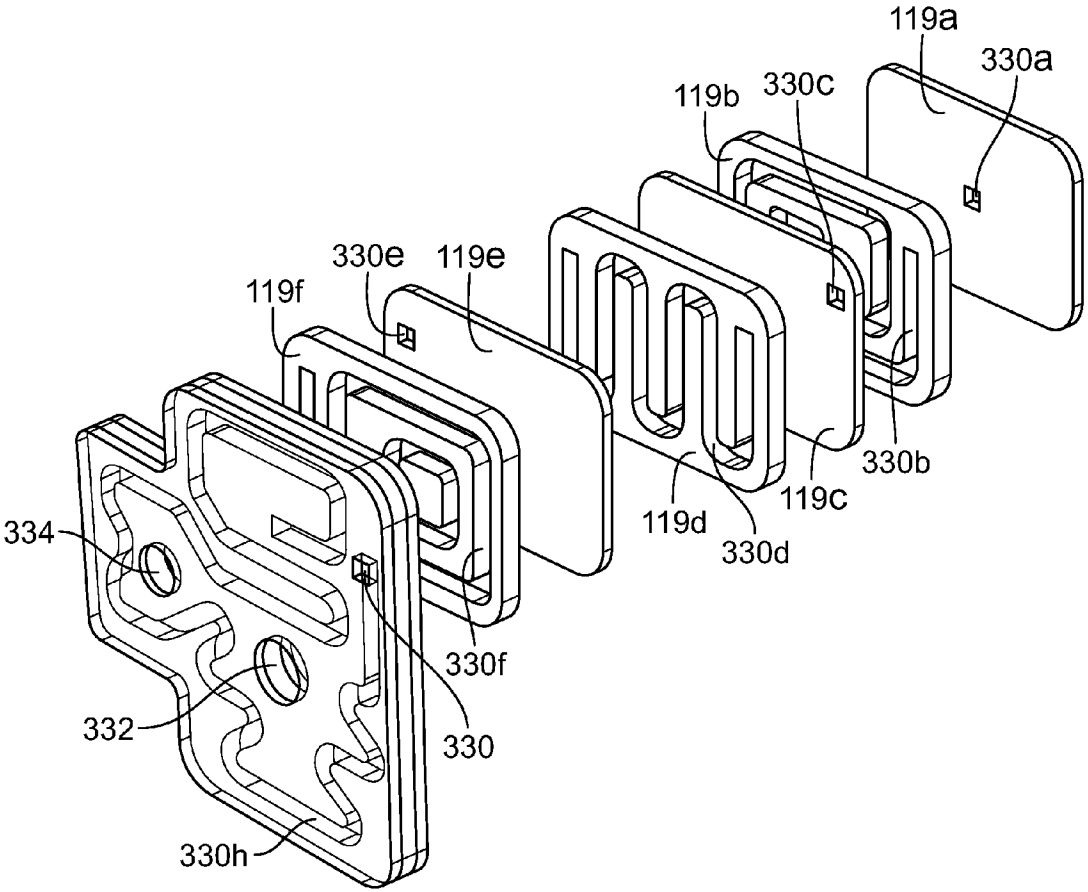
FIG. 5B depicts a front right exploded view of the exemplary embodiment of FIG. 5A.
Figure 5A:
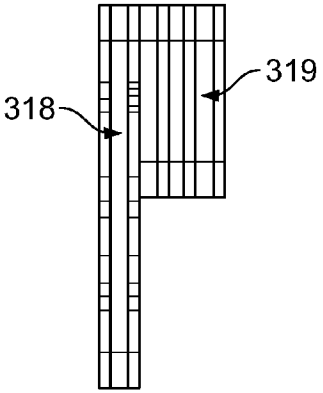
FIG. 5A depicts a right side view of another exemplary embodiment.

FIGS. 5A and 5B depict another exemplary embodiment of the labyrinth 319 and the manifold 318. This design is similar to the design shown and described above in FIGS. 3A and 3B, and similarly numbered components represent like components in the previous embodiment. However, the final pathway 330*h* in the front of the manifold 318 has a different shape and configuration. Additionally, the low frequency output 330, mid-frequency output 332, and the high frequency output 334 can be arranged in different locations based on the design of the earphone.

Figure 6A:
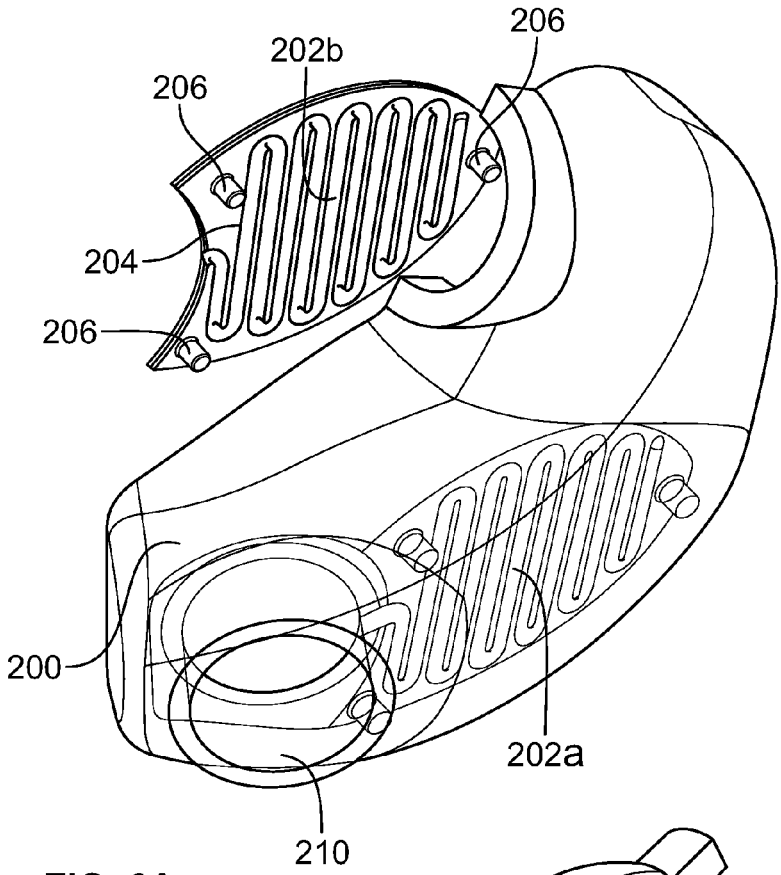
FIG. 6A shows a front right exploded perspective view of another exemplary embodiment of a portion of a case for an earphone assembly.
Figure 6B:
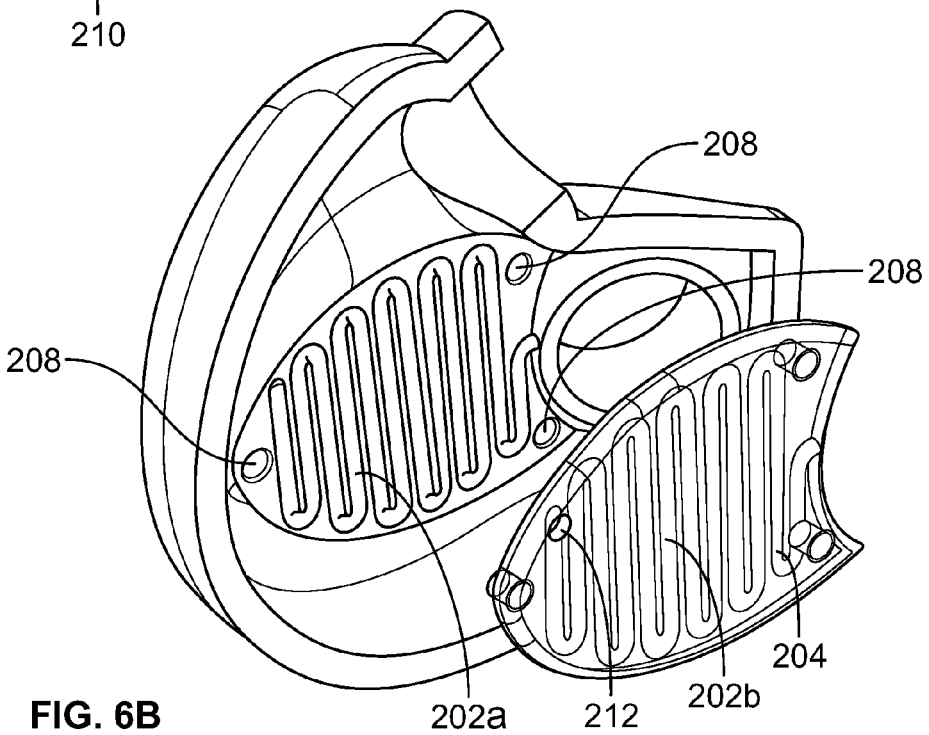
FIG. 6B shows a rear left exploded perspective view of the portion of the case of FIG. 6A.

FIGS. 6A and 6B depict another alternative embodiment, where an internal elongated passageway 202*a*, 202*b* is formed directly in a case 200 itself. In this embodiment, the case 200 of the earphone can be used to provide an increased path length through which the sound from one or more of the drivers must travel. The corresponding increase in acoustic inertance attenuates undesirable high frequencies. The elongated passageway 202*a*, 202*b* can be formed with eleven bends in the elongated channel 202*a*, 202*b* such that the pathway of the passageway 202*a*, 202*b* changes direction 180 degrees eleven times in the housing. However, additional shapes and configurations of the elongated passageway 202*a*, 202*b* are contemplated. Additionally, the elongated passageway can be formed anywhere in an earphone housing to provide additional path length.

The case 200 can be molded or formed such that one or more internal channels 202*a* are formed integral with the case 200 on an inside portion of the case 200. A cover 204 with a corresponding channel 202*b* can be placed onto the inside portion of the case 200 to form the elongated passageway 202*a*, 202*b* for sound from one or more drivers to travel through before entering into a nozzle (not shown) and eventually to the user's ear canal. The cover 204 can be provided with three alignment pins 206, which can be configured to be located and glued within the holes 208 on the inside surface of the case 200. The cover 204 could also be formed of a tape, membrane, or any other suitable covering known in the art.

To route the sound to the internal elongated passageway 202*a*, 202*b* of the case 200, the one or more drivers could be arranged to face outward toward the inside of the case 200 at the internal elongated passageway 202*a*, 202*b*. The output of the driver can be faced toward the elongated passageway 202*a*, 202*b* at the input port 212. The sound output from the one or more drivers can then be routed through the input port 212 to the elongated channel 202*a*, 202*b* in the case 200. The additional components (e.g. drivers, crossover flex PCB, connector, acoustic seal, all not shown) of the earphone can also be arranged in the case 200 and cover (not shown) can be secured to the case 200 to house all of the earphone components. A hole 210 is provided in the case 200 for the nozzle (not shown).

Like the above described embodiments, this arrangement can also help filter undesired high frequency sound output from one or more of the drivers. In particular, like in the above embodiments, the extended length of the elongated channel 202*a*, 202*b* in the housing can provide for the desired filtering of higher frequency sound from the output of the one or more of the drivers.

Figure 8:
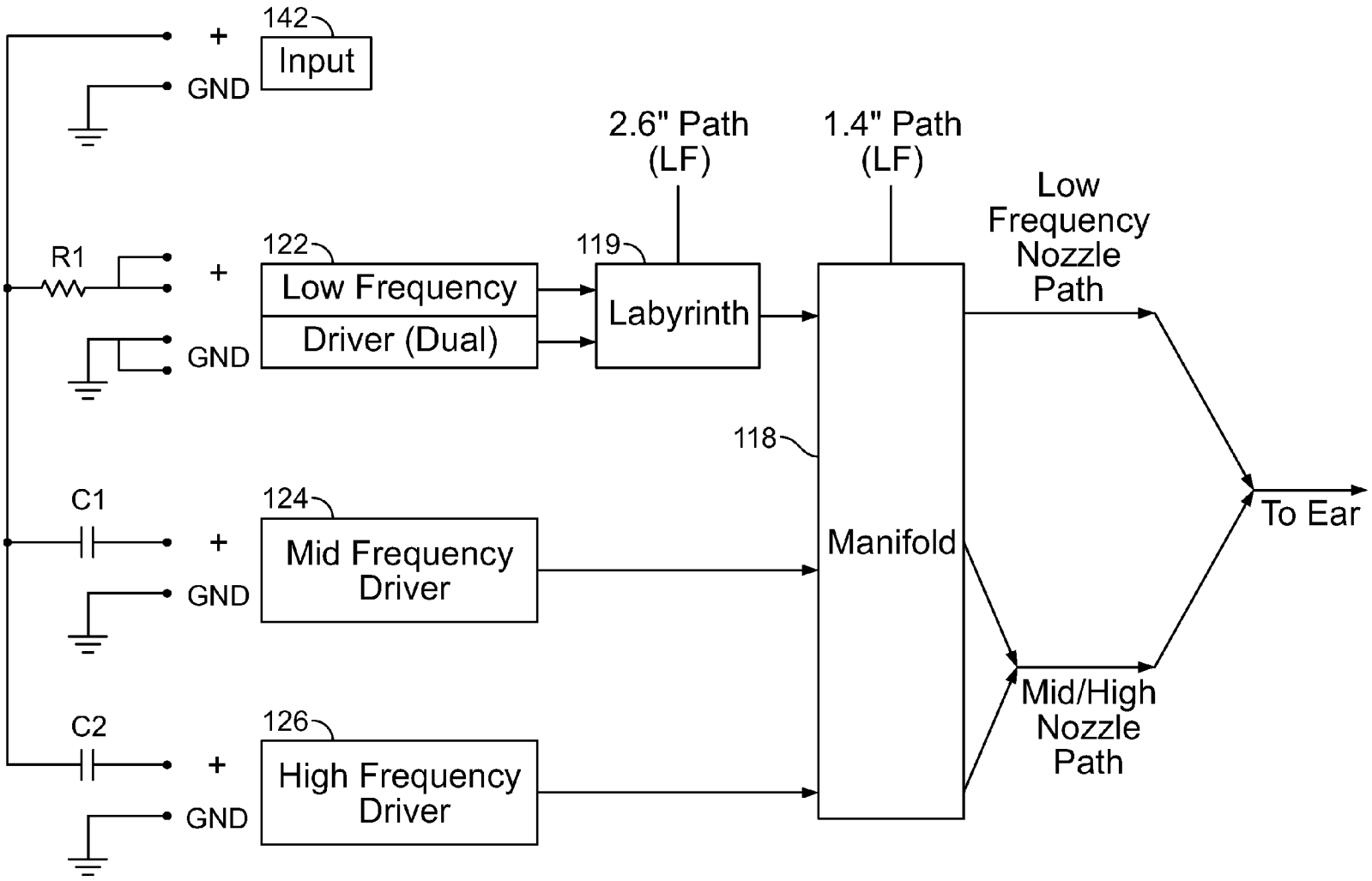
FIG. 8 shows a flow diagram for an exemplary embodiment.

The operation of the exemplary embodiments disclosed herein will now be described with respect to FIGS. 1-3B and the flow diagram shown in FIG. 8. To reproduce a sound signal in the earphone, the cable 120 outputs a signal from an input 142 or sound source such as a mobile device, mp3 player, bodypack transmitter, etc. The signal is then transferred through the connector 109 and to the crossover flex PCB 128. The crossover flex PCB 128 divides the signal into low, mid, and high frequency portions of the signal and routes the low, mid, and high frequency portions of the signal to the corresponding dual low frequency driver 122, mid-frequency driver 124, or high frequency driver 126. The respective signals cause the drivers to output sound through the labyrinth 119 and the manifold 118. The sound output from the mid and high frequency drivers 124 and 126 is output directly through the manifold by way of the mid-frequency port 132 and high frequency port 134 respectively. However, the sound output by the dual low frequency driver 122 is output through the elongated passageway 130 formed in the labyrinth 119 and the manifold 118. The acoustic inertance of the elongated passageway 130 then provides a first-order low-pass filter for the sound output from the low frequency driver 122 to attenuate undesirable high frequencies above the filter's corner frequency.

The sound from the high frequency port 134 and the sound from the mid-frequency port 132 are then output into the first port 136 of the acoustic seal 116. The first port 136 of the acoustic seal 116 mixes the outputs from the high frequency driver 126 and the mid-frequency driver 124. The second port 138 of the acoustic seal 116 receives the output from the dual low frequency driver 122 through the elongated passage 130. The separate outputs from the first port 136 and the second port 138 of the acoustic seal 116 are then transferred into the nozzle interface 110. Each separate output is provided to the nozzle 112 from the nozzle interface 110. The nozzle 112 can also be configured to maintain the outputs acoustically separate until the sound reaches the end of the nozzle 112. The nozzle 112 mates with a sleeve (not shown), which is inserted into a user's ear and couples the earphone 100 to a user's ear. The nozzle 112 is configured to project the sound directly into a user's ear canal. The flow diagram in FIG. 8 generally diagrams how the sound will travel through an earphone disclosed in the embodiments in FIGS. 1-5B.

Aspects of the invention have been described in terms of illustrative embodiments thereof. Numerous other embodiments, modifications and variations within the scope and spirit of the disclosed invention will occur to persons of ordinary skill in the art from a review of this entire disclosure. For example, one of ordinary skill in the art will appreciate that the steps illustrated in the illustrative figures may be performed in other than the recited order, and that one or more steps illustrated may be optional in accordance with aspects of the disclosure.

What is claimed is:

1. An earphone assembly comprising:

a housing;

a first driver configured to produce a first audio output;

a second driver configured to produce a second audio output;

a nozzle coupled to the housing; and an elongated passageway connected to the first driver and contained within the housing, the elongated passageway having a length and cross sectional area and comprising a tortuous path having multiple turns winding internally within the housing, wherein at least a portion of the elongated passageway forms a labyrinth comprising a plurality of integral layers, wherein the length and cross-sectional area of the elongated passageway are configured as an acoustic filter for filtering at least an audible portion of the sound from the audio output of the first driver.

2. The earphone assembly of claim 1 wherein one or more of the layers of the labyrinth form an elongated channel extending lengthwise, widthwise, or combinations thereof on the largest surface area of the layer.

3. The earphone assembly of claim 2 wherein the elongated channel of the one or more layers is formed as a wave or spiral shape.

4. The earphone assembly of claim 2 further comprising a manifold wherein the manifold comprises a passageway which forms part of the elongated passageway.

5. The earphone assembly of claim 4 wherein the manifold comprises a plurality of integral layers wherein one or more of the layers of the manifold form an elongated channel and wherein an elongated channel formed in one or more of the layers of the manifold is a greater length than the length of an elongated channel formed in one or more of the layers of the labyrinth.

6. The earphone assembly of claim 4 wherein the manifold further comprises an additional passageway for receiving sound directly from the second driver, the second driver configured to output a higher frequency sound than the first driver.

7. The earphone assembly of claim 4 wherein a damping mechanism is provided in the manifold and wherein the damping mechanism comprises a plurality of holes formed into a layer forming the manifold.

8. The earphone assembly of claim 1 wherein at least a portion of the shape of the elongated passageway is spiral or wave.

9. The earphone assembly of claim 1 wherein the elongated passageway is integrally formed within a portion of the housing.

10. The earphone assembly of claim 1 wherein the elongated passageway has a constant diameter.

11. The earphone assembly of claim 1 wherein the labyrinth is formed in the shape of a prism.

12. An earphone assembly comprising:

a housing configured to receive a nozzle for outputting sound; and a plurality of drivers each having an output disposed within the housing, wherein at least one of the drivers is connected to an elongated passage acoustically coupled to the nozzle;

wherein at least a portion of the elongated passageway forms a labyrinth comprising a plurality of integral layers, wherein the elongated passageway is formed of a network of differently shaped passages disposed within the housing, wherein the elongated passageway extends in each of the X, Y, and Z directions, and wherein the length and cross-sectional area of the elongated passageway are configured to filter at least an audible portion of a sound wave output from the at least one of the plurality of drivers.

13. The earphone assembly of claim 12 wherein at least a portion of the path of the elongated passageway comprises a wave or a spiral shape.

14. The earphone assembly of claim 12 wherein an elongated channel extending lengthwise, widthwise, or combinations thereof is formed on one or more of the layers of the labyrinth on the largest surface area of the layer.

15. The earphone assembly of claim 14 wherein the earphone assembly further comprises a manifold and wherein the manifold provides a pathway which provides at least a portion of the elongated passageway.

16. The earphone assembly of claim 15 wherein a damping mechanism is provided in the manifold and wherein the damping mechanism comprises a plurality of holes formed into a layer forming the manifold.

17. The earphone assembly of claim 15 wherein the manifold comprises a plurality of integral layers wherein one or more of the layers of the manifold form an elongated channel and wherein an elongated channel formed in one or more of the layers of the manifold is a greater length than the length of an elongated channel formed in one or more of the layers of the labyrinth.

18. The earphone assembly of claim 12 wherein the labyrinth is formed in the shape of a prism.

19. A method of filtering an acoustic output in an earphone comprising:

forming an elongated passageway from a plurality of stacked layers;

housing the elongated passageway and at least one driver configured to provide an acoustic output within an earphone casing;

connecting the output of the at least one driver to the elongated passageway and configuring the acoustic output to be received within the elongated passageway to acoustically filter at least a portion of the acoustic output from the at least one driver.

20. The method of claim 19 wherein the plurality of stacked layers and the passageway form a labyrinth and wherein a first subset of the stacked layers have passages formed of different shapes.

21. The method of claim 20 wherein a second subset of the stacked layers have holes permitting sound to pass through each of the second subset of stacked layers into an adjoining one of the first subset of the stacked layers.

22. The method of claim 20 further comprising laser welding the stacked layers together.

23. The method of claim 22, wherein the plurality of stacked layers comprises alternating layers of the first and second subsets.

24. The method of claim 19 wherein the at least one driver is a low frequency driver and the elongated passageway is configured to filter high frequency sound from the low frequency driver.

25. The method of claim 19 further comprising providing a manifold wherein the elongated passage is partially formed within the manifold.

26. The method of claim 25 further comprising forming the manifold from a series of stacked layers.

27. The method of claim 26 further comprising providing a damping mechanism in the manifold by providing a plurality of holes in a layer forming the manifold.

28. The method of claim 19 further comprising forming at least a portion of the path of the elongated passageway as a wave or a spiral shape.

29. The method of claim 19 further comprising forming the elongated passageway such that it extends in each of the X, Y, and Z directions.

30. The method of claim 19 wherein the labyrinth is formed by 3D printing.

31. The method of claim 19 wherein the labyrinth is formed by micro lithography.

* * * * *